US011350726B2

(12) United States Patent
Davic et al.

(10) Patent No.: US 11,350,726 B2
(45) Date of Patent: Jun. 7, 2022

(54) MORTAR TRANSPORTATION SYSTEM

(71) Applicant: The United States of America, as represented by the Secretary of the Navy, Crane, IN (US)

(72) Inventors: Steven Davic, Crane, IN (US); Ethan L Spaid, Brooklyn Center, MN (US); Charles R. Greer, Crane, IN (US); Christopher Brown, Bloomington, IN (US); Joseph Jachim, Bloomington, IN (US); Adriann Nicole Wilson, Crane, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/521,639

(22) Filed: Jul. 25, 2019

(65) Prior Publication Data

US 2020/0077773 A1 Mar. 12, 2020

Related U.S. Application Data

(60) Provisional application No. 62/703,371, filed on Jul. 25, 2018.

(51) Int. Cl.

| | |
|---|---|
| ***A45F 3/06*** | (2006.01) |
| ***A45F 3/08*** | (2006.01) |
| ***A45F 3/10*** | (2006.01) |
| *A45F 3/00* | (2006.01) |

(52) U.S. Cl.

CPC ..... *A45F 3/06* (2013.01); *A45F 3/08* (2013.01); *A45F 3/10* (2013.01); *A45F 2003/003* (2013.01); *A45F 2200/0566* (2013.01)

(58) Field of Classification Search

CPC ..... A45F 3/06; A45F 3/08; A45F 3/10; A45F 2003/003; A45F 2200/0566

USPC ..... 224/261

See application file for complete search history.

(56) References Cited

U.S. PATENT DOCUMENTS

| | | | | | |
|---|---|---|---|---|---|
| 2,943,775 | A * | 7/1960 | Mack | B63C 11/02 | 224/628 |
| 3,378,222 | A * | 4/1968 | Erickson | F21V 27/005 | 248/692 |
| 4,685,601 | A * | 8/1987 | Riddling | A62C 33/04 | 224/261 |
| 5,579,966 | A * | 12/1996 | Krumweide | A45F 3/08 | 224/259 |
| 6,364,187 | B1 * | 4/2002 | Castellano | A45F 5/02 | 224/236 |
| 6,412,674 | B1 * | 7/2002 | Lipke | A45C 7/00 | 224/235 |
| 6,823,992 | B2 * | 11/2004 | Redzisz | A45C 13/04 | 206/373 |

(Continued)

*Primary Examiner* — Peter N Helvey

(74) *Attorney, Agent, or Firm* — Naval Surface Warfare Center, Crane Division; Eric VanWiltenburg

(57) ABSTRACT

The present invention relates to a backpack system for transporting items and an accompanying device. In exemplary embodiments, carried items are kept secure within a plurality of item holders to prevent the items from moving. The item holders can be rigid structures like cylinders or flexible canvas pouches. In exemplary embodiments, the backpack system can have configurations for carrying either a device or additional items.

8 Claims, 5 Drawing Sheets

(56) References Cited

U.S. PATENT DOCUMENTS

| | | | | |
|---|---|---|---|---|
| 7,559,445 | B1 * | 7/2009 | Kulp | A45F 3/14 224/627 |
| 9,839,279 | B2 * | 12/2017 | Seuk | A45F 3/14 |
| 9,861,179 | B2 * | 1/2018 | Kotter | A45F 3/14 |
| 2010/0176172 | A1 * | 7/2010 | Gleason, Jr. | A45F 3/08 224/635 |
| 2017/0143106 | A1 * | 5/2017 | Kotter | A45F 3/08 |

* cited by examiner

MORTAR TRANSPORTATION SYSTEM

CROSS-REFERENCE TO RELATED APPLICATIONS

The present application claims priority to U.S. Provisional Patent Application Ser. No. 62/703,371, filed Jul. 25, 2019, entitled "MORTAR PACK," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,555) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The present invention relates to backpack systems for transporting items.

BACKGROUND AND SUMMARY OF THE INVENTION

The present invention relates to a backpack system for transporting cumbersome and delicate items. Previous systems are difficult to unload, remove, and wear for extended periods of time.

According to an illustrative embodiment of the present disclosure, a backpack system can have a designated device holder and item holder sections to transport a device and items which operate with the device. The backpack system allows the device and items to be quickly and easily transported and withdrawn from the system without restraining movement, causing discomfort, or damaging the device, the items, or the system.

According to a further illustrative embodiment of the present disclosure, a backpack system can have flexible item holders. When unused, item holders can be collapsed to reduce their size. In exemplary embodiments, a device can be placed be left and right item holders. Collapsing the innermost item holders can create more space for a device.

According to a further illustrative embodiment of the present disclosure, a backpack system can have a configurable center portion wherein a first configuration allows transport of a device and a second configuration allows transport of additional items instead of a device.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
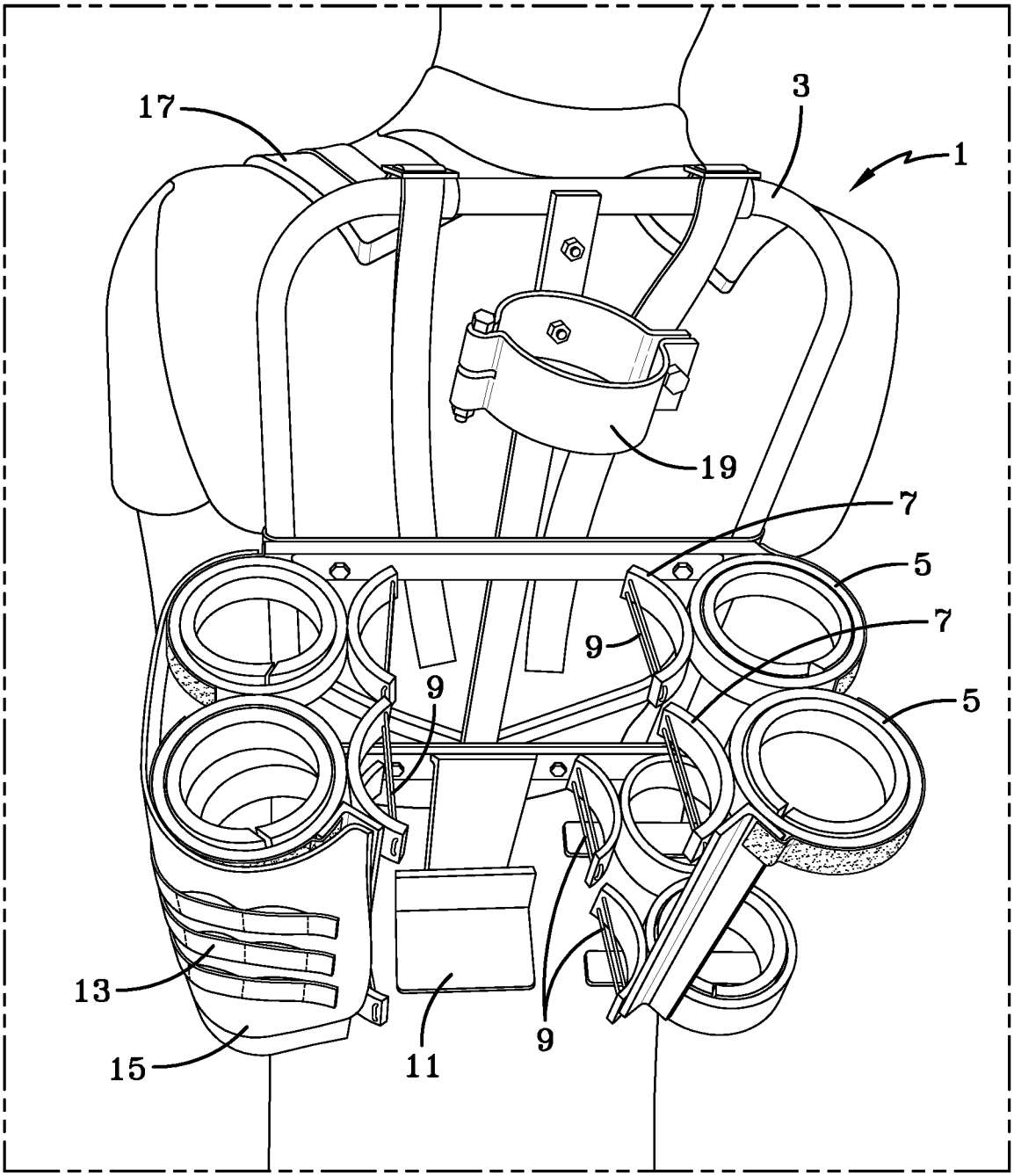
FIG. 1 shows an isometric view of an exemplary configurable backpack system.

FIG. 1 shows an isometric view of a configurable embodiment of an exemplary backpack system 1. A frame 3 provides support for the system and allows components to be attached to the frame 3. Frame 3 is coupled to backpack 17. Backpack 17 can be a standalone backpack that can be worn without frame 3, or backpack 17 can be a front-worn portion coupled to frame 3, wherein frame 3 is the only back-worn portion of backpack system 1. A plurality of rigid item holders 5 are coupled to a left side and right side of the frame 3. Rigid item holders 5 can be shaped to fit a particular type of item, forming a complete ring or cylinder. Rigid item holders 5 are positioned such that the left-most and right-most edges of the holders do not extend beyond the arms of an operator wearing backpack system 1. This positioning helps operators maintain balance when wearing backpack system 1, particularly when an operator is moving through rugged terrain or moving outside the range of normal walking motion (e.g., bending over, avoiding obstacles, etc.). A plurality of partial item holders 7 can be coupled to the inside-facing edges of rigid item holders 5. Partial item holders 7 can form a partial ring or cylinder ending at open edges, with a flexible strap 9 (e.g., an elastic band) on each partial item holder connecting the open edges. A support ledge 11 coupled to a bottom side of backpack system 1 is positioned in line with the attachment collar 19 and between the second plurality of plurality of partial item holders 7. The support ledge 11 can provide support to a device in the second configuration such that the device will rest upon support ledge 11 to prevent the device from moving during operator movement. Support ledge 11 can be coupled to frame 3 such that support ledge 11 is approximately flush with a flat surface on which an operator sits. A flexible covering 13 (e.g., MOLLE) can be placed around the rigid item holders 5 to allow additional equipment (e.g., tools) to be coupled (e.g., clipped) to backpack system 1. Covering 13 can include a pouch 15 to carry additional equipment. A collar 19 coupled to frame 3 above the first and second plurality of item holders 5, 7 is adapted to couple to the device (e.g., around the upper saddle of a mortar tube) to further keep the device from moving during operator movement.

In a first configuration, backpack system 1 can store items in partial item holders 7 by inserting items into a center section of partial item holders 7 such that the flexible straps 9 hold the items in place (e.g., by expanding an elastic band around each item to hold the item against a respective partial item holder 7). In a second configuration, backpack system 1 can store a device in a gap between the left and right partial item holders 7 when the partial item holders 7 are empty. In the first configuration, up to eight items can be transported. In the second configuration, up to four items can be transported.

Figure 2:
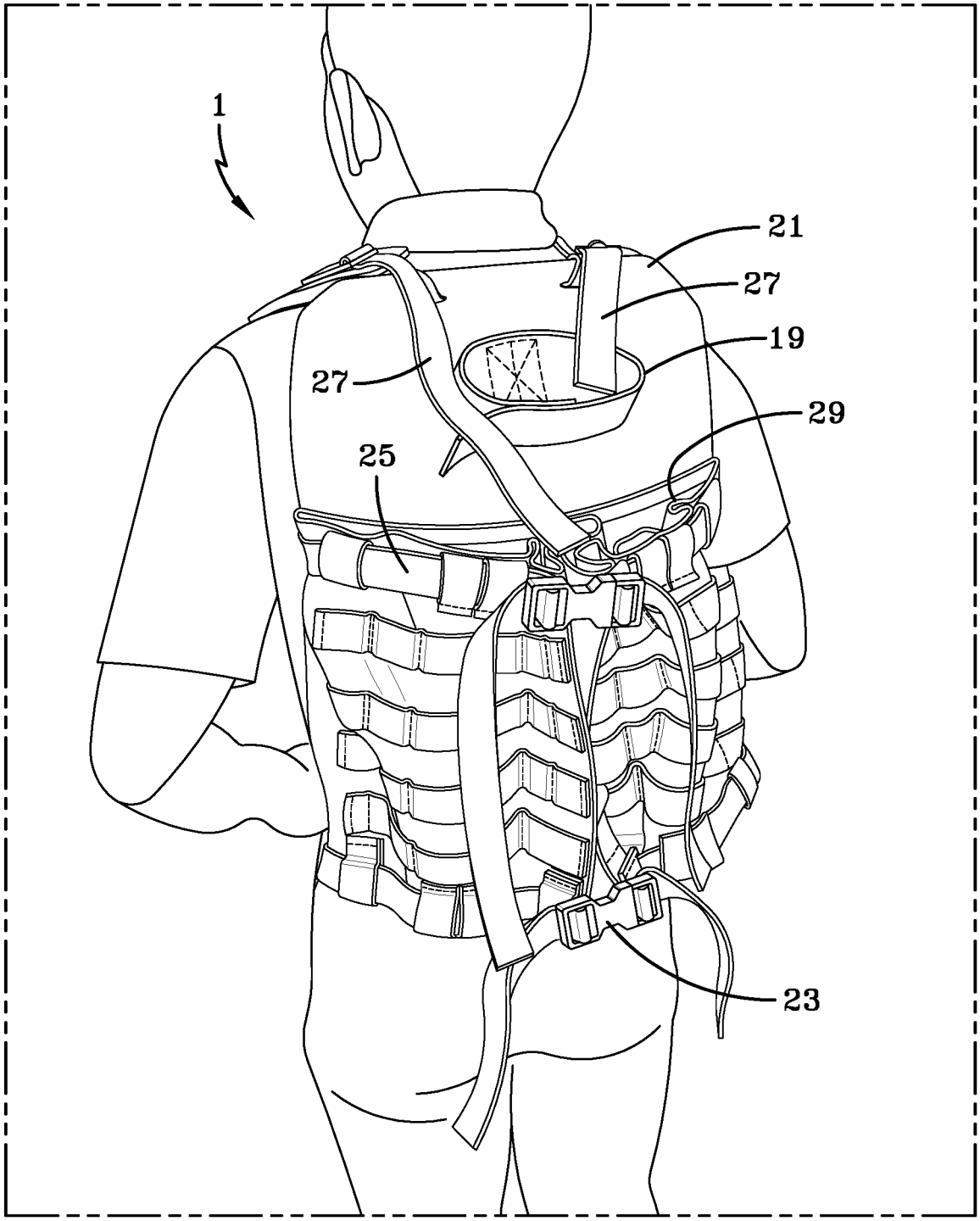
FIG. 2 shows a rear view of an exemplary flexible backpack system.

FIG. 2 shows a rear view of a flexible embodiment of an exemplary backpack system 1. A covering 21 can fit over a frame (not shown). Collar 19 can be coupled to covering 21. A plurality of flexible item holders 29 are coupled to a left side and right side of the covering 21. Flexible item holders 29 can conform to the shape of items inserted into flexible item holders 29 through elastic bands in the lining of flexible item holders 29. When an item has not been placed inside a flexible item holder 5, the elastic band compresses the holder. A lower strap 23 and upper strap 25 can prevent flexible item holders 29 from moving during operator movement. Lower strap 23 and upper strap 25 are adjustable to tighten the straps (e.g., to further inhibit movement) or loosen the straps (e.g., to allow more items to be inserted into flexible item holders 29). A device strap 27 can wrap around a device (e.g., the lower saddle of a mortar tube) to prevent the device from moving during operator movement. In a first configuration, backpack system 1 can store items in all of the flexible item holders 29. In a second configuration, backpack system 1 can store a device in a gap between the left and right groups of flexible item holders 29 when the innermost (relative to the operator) flexible item holders 29 are empty, with the device occupying the unused space. In the second configuration, lower strap 23 wraps around a bottom portion of the device (e.g., the base plate of a mortar tube). In the first configuration, up to eight items can be transported. In the second configuration, the number of items that can be transported depends on the size of the device; for larger devices, fewer items must be transported to provide extra space for the device. To transport a typical mortar tube and mortar rounds, a maximum of six mortar rounds can be transported.

Figure 3:
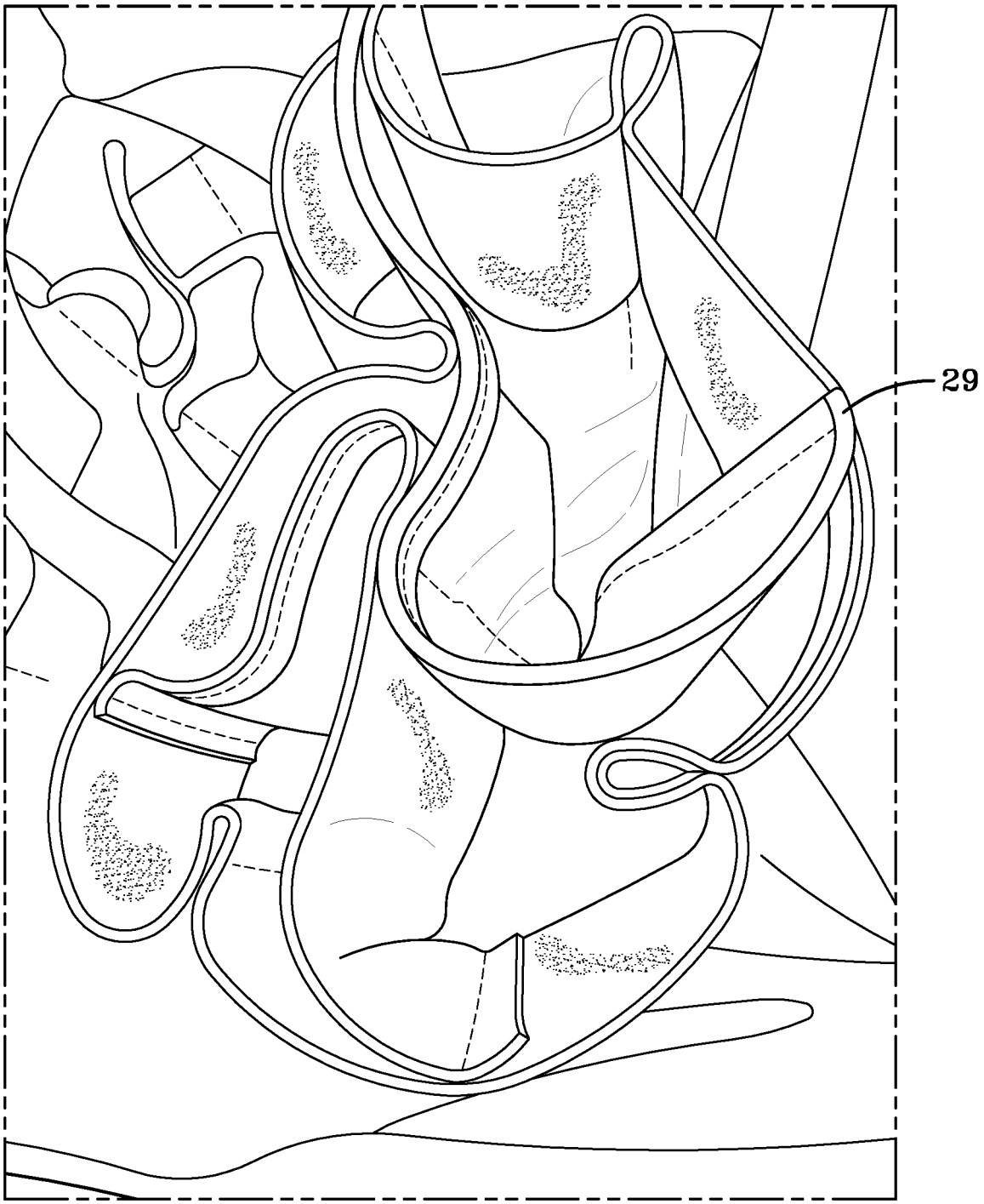
FIG. 3 shows a close up view of exemplary flexible item holders.

FIG. 3 shows a close up view of exemplary flexible item holders 29. Elastic bands compress the flexible item holders 29 when the holders are empty to help minimize space usage.

Figure 4:
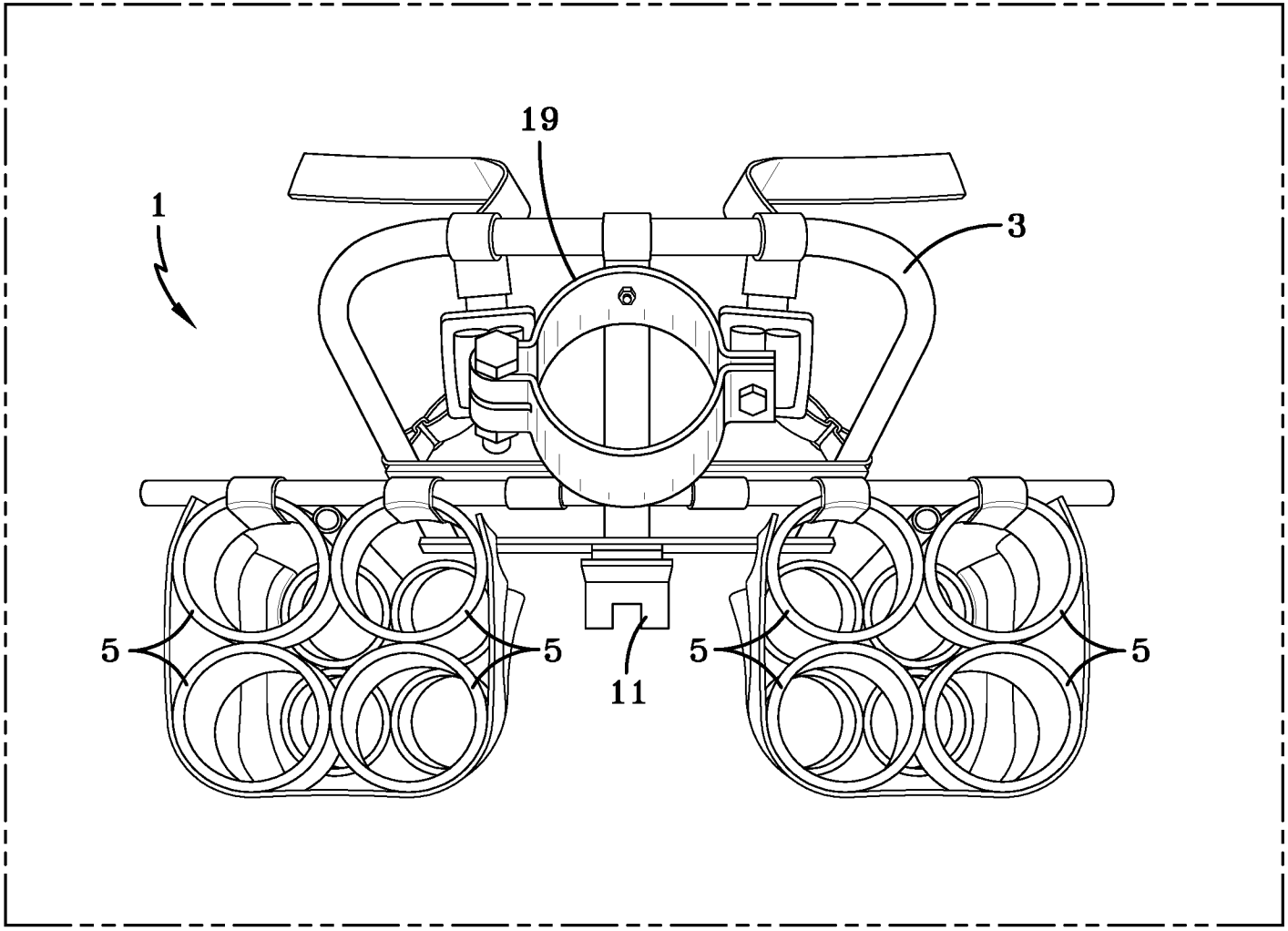
FIG. 4 shows a top-down view of an exemplary backpack system.

FIG. 4 shows a top-down view of a rigid embodiment of an exemplary backpack system 1. This embodiment can be up to eight items in rigid item holders 5 while also carrying a device. Support ledge 11 and collar 19 provide support for the device.

Figure 5:
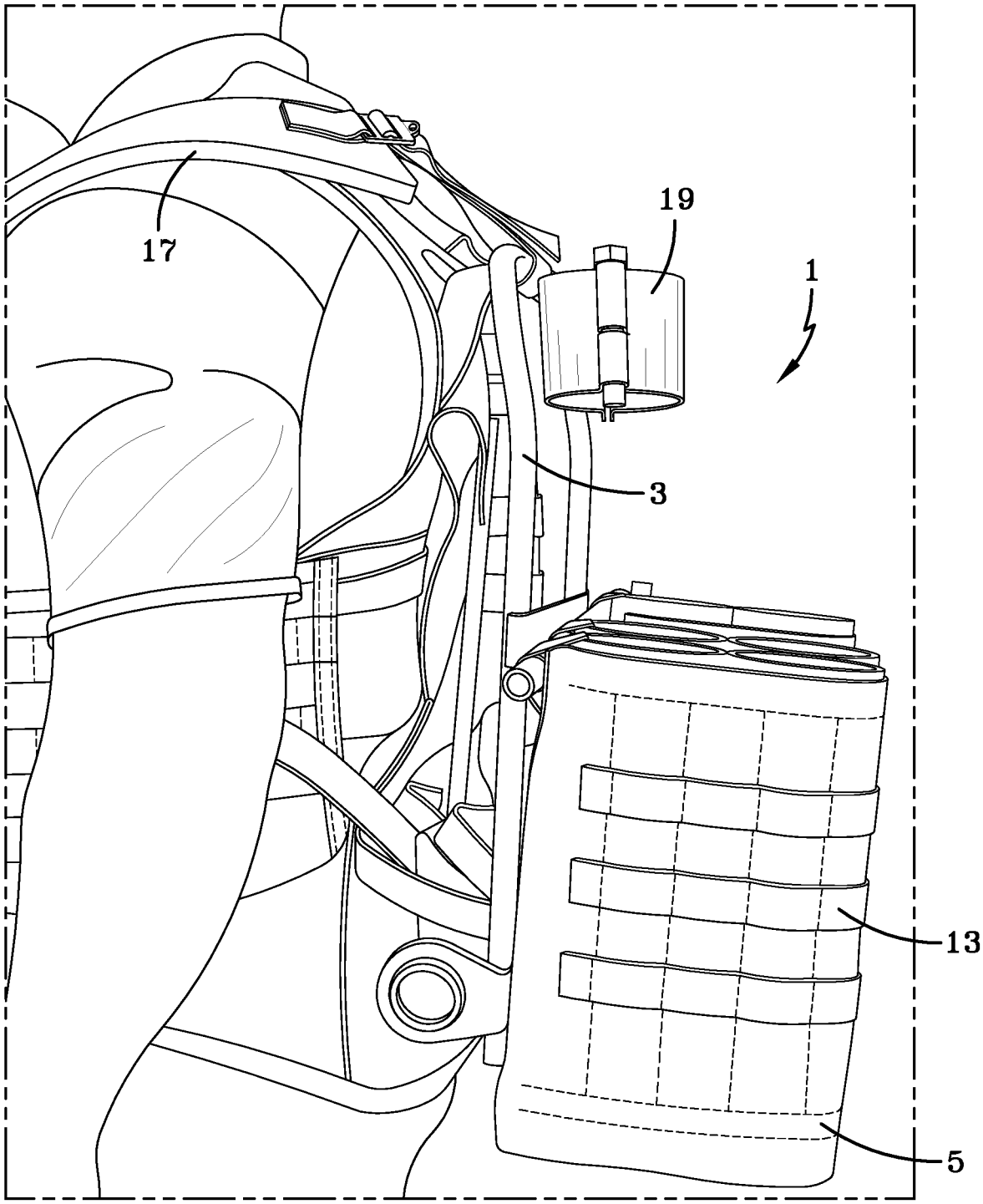
FIG. 5 shows a profile view of an exemplary backpack system.

FIG. 5 shows a profile view of an exemplary backpack system 1.

Although the invention has been described in detail with reference to certain preferred embodiments, variations and modifications exist within the spirit and scope of the invention as described and defined in the following claims.

The invention claimed is:

1. A backpack system comprising:

a frame comprising a left and a right side;

a first plurality of item holders forming a complete ring or cylinder and coupled to the left side and the right side of the frame;

a second plurality of item holders coupled to the inside-facing edges of the first plurality of item holders;

an attachment collar coupled to the frame above the first and second plurality of item holders;

a support ledge coupled to the frame at a bottom side of the backpack in line with the attachment collar and between the second plurality of item holders; and a flexible covering comprising MOLLE placed around the first and second plurality of item holders;

wherein the backpack system is configured to couple to a device in a first configuration, wherein the device is disposed between a first half and a second half of the second plurality of item holders, the second plurality of the item holders are obstructed by the device, a first end of the device touches a top edge of the support ledge, and the attachment collar is coupled to the device;

wherein in a second configuration, the device is not coupled to the backpack system and the second plurality of item holders is configured to hold items.

2. The backpack system of claim 1:

wherein each item holder of the first plurality of item holders comprises a cylinder or plurality of rings, wherein the cylinder or plurality of rings are adapted to prevent an item placed within an item holder of the first plurality of item holders from moving;

wherein each item holder of the second plurality of item holders comprises at least two elastic bands and a partial cylinder or a plurality of partial rings, wherein the at least two elastic bands are couple to the partial cylinder or plurality of partial rings such that when an item is placed within an item holder of the second plurality of item holders, the elastic bands hold the item against the partial cylinder or plurality of partial rings with friction.

3. The backpack system of claim 2, further comprising:

at least one flexible sheet comprising at least one strap and at least one sealable pocket, wherein the at least one flexible sheet is coupled to outer surfaces of the first plurality of item holders.

4. The backpack system of claim 1:

wherein each item holder of the first and second pluralities of item holders comprises a flexible sleeve and at least one elastic band;

wherein when an item holder of the first and second plurality of item holders is empty, the at least one elastic band compresses the item holder of the second plurality of item holders;

wherein when an item is placed within an item holder of the second plurality of item holders, the at least one elastic band prevents the item from moving.

5. The backpack system of claim 4, the first plurality of item holders further comprising at least one strap on an outer facing surface of the first plurality of item holders.

6. The backpack system of claim 4, further comprising:

first and second frame support straps each coupled to the frame at a top and bottom of the frame, wherein the first and second frame support straps are adapted to permit an operator to insert their arms between the first and second frame support straps and the frame to wear the backpack system;

a device support strap coupled to the first and second frame support straps, wherein the device support strap is adapted to couple to the device.

7. The backpack system of claim 6, wherein the device is a mortar tube, wherein the device support strap couples to the device at the lower saddle of the mortar tube, wherein the collar couples to the device at the upper saddle of the mortar tube.

8. The backpack system of claim 4, further comprising:

a first and a second holder support strap coupled to the frame, wherein the tightening the first and second holder support straps tightens the flexible.

* * * * *